United States Patent [19]

Sayles et al.

[11] Patent Number: 4,898,663

[45] Date of Patent: Feb. 6, 1990

[54] METHOD FOR CONTROLLING SEDIMENTATION IN AN EBULLATED BED PROCESS

[75] Inventors: Scott M. Sayles; William B. Livingston; Michael P. Bellinger, all of Baton Rouge, La.

[73] Assignee: Texaco Inc., White Plaine, N.Y.

[21] Appl. No.: 275,831

[22] Filed: Nov. 25, 1988

[51] Int. Cl.[4] ..... C10G 17/00; C10G 45/20

[52] U.S. Cl. ..... 208/178; 208/108; 208/112; 208/157

[58] Field of Search ..... 208/DIG. 1, 112, 162, 208/177, 157, 154, 143, 178

[56] References Cited

U.S. PATENT DOCUMENTS

| | | | |
|---|---|---|---|
| 2,728,641 | 12/1955 | Thorp et al. | 208/162 |
| 2,902,434 | 9/1959 | Burton et al. | 208/154 |
| 3,005,554 | 10/1961 | Kuntz | 208/DIG. 1 |
| 3,368,965 | 2/1968 | Schuman | 208/112 |
| 3,423,307 | 1/1969 | McKinney et al. | 208/216 R |
| 3,547,809 | 12/1970 | Ehrlich et al. | 208/143 |
| 3,549,517 | 12/1970 | Lehman et al. | 208/108 |
| 3,591,484 | 7/1971 | Peck et al. | 208/48 AA |
| 3,666,932 | 5/1972 | White | 208/DIG. 1 |
| 3,870,623 | 3/1975 | Johnson et al. | 208/112 |
| 3,887,455 | 6/1975 | Hamner et al. | 208/112 |
| 4,053,390 | 10/1977 | James | 208/157 |
| 4,059,502 | 11/1977 | James | 208/157 |
| 4,075,082 | 2/1978 | Doelp et al. | 208/422 |
| 4,485,006 | 11/1984 | Bicerogw | 208/216 R |
| 4,684,456 | 8/1987 | Van Driesen et al. | 208/DIG. 1 |
| 4,750,989 | 6/1988 | Soderberg | 208/143 |

*Primary Examiner*—Anthony McFarlane

*Attorney, Agent, or Firm*—Jack H. Park; Kenneth R. Priem; Richard A. Morgan

[57] ABSTRACT

In an ebullated bed process, it has been found that in switching from one sediment yielding feedstock to a second sediment yielding feedstock that the transient sediment concentration is 5 to 8 times the steady state concentration. Such transients have caused unit shutdowns with lost production time.

A method has been found which avoids these high transient sediment concentrations. Second feedstock is added incrementally (1 vol % to 2 vol % of the final rate) over the period of a week or more and sediment in the product analyzed. After full second feedstock rate is achieved, first feedstock is reduced incrementally with sediment analysis. Higher unit utilization is achieved with the corresponding increased yearly production.

3 Claims, 1 Drawing Sheet

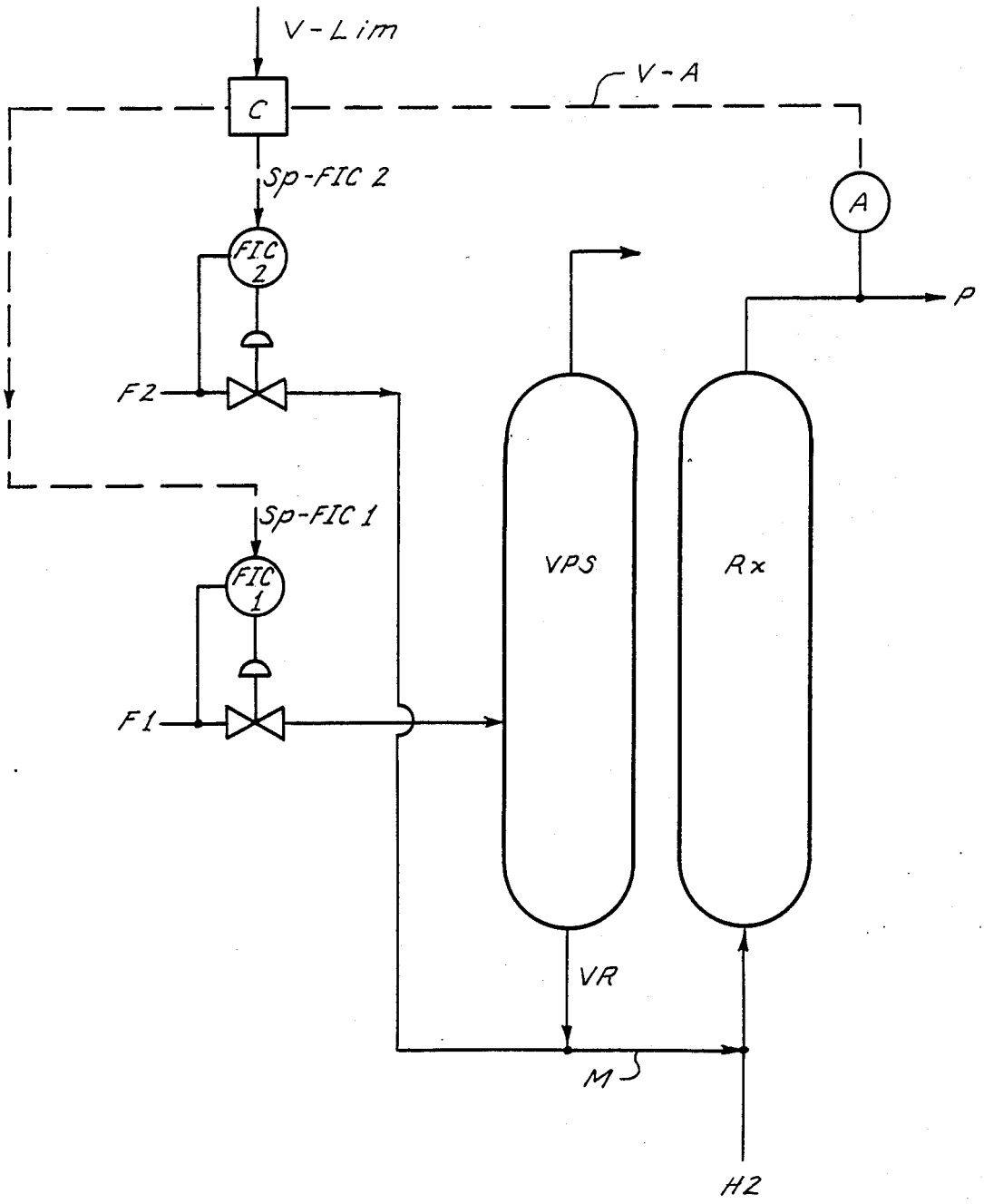
V-Lim
C
V-A
Sp-FIC 2
A
FIC 2
P
F2
Sp-FIC 1
VPS
Rx
FIC 1
F1
VR
M
H2

METHOD FOR CONTROLLING SEDIMENTATION IN AN EBULLATED BED PROCESS

BACKGROUND OF THE INVENTION

1. Field of the Invention

This invention relates to a control system for an ebullated bed process. The invention also relates to a method for changing feedstock in an ebullated bed process from a sediment yielding feedstock to a different sediment yielding feedstock.

2. Description of Other Relevant Methods in the Field

The ebullated bed process comprises the passing of concurrently flowing streams of liquids, or slurries of liquids and solids, and gas through a vertically cylindrical vessel containing catalyst. The catalyst is placed in random motion in the liquid and has a gross volume dispersed through the liquid greater than the volume of the mass when stationary. The ebullated bed process has found commercial application in the upgrading of heavy liquid hydrocarbons and converting coal to synthetic oils.

The process is generally described in U.S. Pat. No. Re. 25,770 to Johanson incorporated herein by reference. A mixture of hydrocarbon liquid and hydrogen is passed upwardly through a bed of catalyst particles at a rate such that the particles are forced into random motion as the liquid and gas pass upwardly through the bed. The catalyst bed motion is controlled by a recycle liquid flow so that at steady state, the bulk of the catalyst does not rise above a definable level in the reactor. Vapors along with the liquid which is being hydrogenated pass through that upper level of catalyst particles into a substantially catalyst free zone and are removed at the upper portion of the reactor.

Reactors employed in a catalytic hydrogenation process with an ebullated bed of catalyst particles are designed with a central vertical recycle conduit which serves as the downcomer for recycling liquid from the catalyst free zone above the ebullated catalyst bed to the suction of a recycle pump to recirculate the liquid through the catalytic reaction zone. The recycling of liquid from the upper portion of the reactor serves to ebullate the catalyst bed, maintain temperature uniformity through the reactor and stabilize the catalyst bed.

U.S. Pat. No. 4,053,390 to L. C. James teaches a start-up procedure for an ebullated bed process. In the procedure, a light oil is used to establish an ebullating bed. A heavy residual oil feedstock is incrementally substituted for the light oil. Hydrogen gas flow rate and ebullating pump speed are set to maintain ebullated bed expansion. In the incrementally changing feed stream, viscosity is controlled within ±10% and specific gravity controlled within ±5% to maintain a constant expansion of the ebullated bed, at a constant ebullating pump rate and gas flow rate.

SUMMARY OF THE INVENTION

The invention is a method for changing feedstock in an ebullated bed process from a first feedstock to a second feedstock of different sediment yield.

The ebullate bed process is a continuous process for treating a fluid hydrocarbon feedstock with a hydrogen-containing gas at elevated catalytic reaction temperatures in the presence of a particulate solid catalyst. In the process, the hydrogen-containing gas and feedstock are introduced into the lower end of a vertical reaction vessel wherein the catalyst is placed in random motion within the fluid hydrocarbon and the catalyst bed is expanded to a volume greater than its static volume. The mixture of feedstock, gas and catalyst comprises a turbulent zone from which aged catalyst is removed and fresh catalyst is added. The upper portion of the turbulent zone is defined by an interface with a substantially catalyst depleted zone from which hydrocracked product is removed.

In the improved method, the flow rate of the first feedstock (F1) is set at a first flow rate F1(1). Flow of second feedstock (F2) is then initiated at an initial flow rate (F2(1)). Sediment concentration in the product is measured and second flow rate is increased incrementally to the limit of a preselected tolerable sediment concentration (v-Lim) in the hydrocracked product (P). Finally, the desired steady state flow rate (F2(SS)) of second feedstock (F2) is achieved.

The flow rate of first feedstock (F1) is reduced incrementally, to the same sediment in cracked product limitation (V-Lim), until the flow rate of first feedstock (F1) is terminated.

High transient sediment concentration with associated downstream equipment plugging is avoided.

BRIEF DESCRIPTION OF THE DRAWING

The drawing is a schematic representation of the control system to facilitate a method for switching from a sediment yielding feedstock to a feedstock of different sediment yield in an ebullated bed process.

DETAILED DESCRIPTION OF THE DRAWING

A first feedstock (F1) such as a Saudi Arabian crude is fractionated in a vacuum pipe still (VPS), to yield a vacuum residuum (VR) which produces low amounts of sediment when passed along with a hydrogen-containing gas (H2) upwardly through an ebullated bed of catalyst (Rx) in a hydrocracking zone at a temperature of 650° F. to 950° F. and hydrogen partial pressure in the range of 1000 psia to 5000 psia. Sediment analyzer (A) produces a value (V−A) corresponding to the concentration of sediment in the product (P) indicating that first feedstock (F1) is yielding a low sediment concentration, e.g. below the threshold of analysis.

A second feedstock (F2) such as a visbreaker residuum bottoms is known to produce large amounts of sediment when processed in an ebullated bed (Rx). In particular, the largest amounts of sediment are produced during transient operation. The total amount of sediment produced is not susceptible to control by this method. However, the sediment concentration can be controlled to prevent high transient sediment concentrations which have plugged downstream equipment during feedstock switching.

In switching from the first feedstock (F1) to the second feedstock (F2), the flow rate of the first feedstock (F1) is set at a first flow rate F1(1) on first flow rate indicator and controller (FIC 1). Flow of second feedstock (F2) is then initiated on second flow indicator and controller (FIC 2) in the amount of F2(1), an increment which may be 0.1 vol % to 5 vol %, preferably 1 vol % to 2 vol % of the final flow rate. Total flow (M) to the reactor Rx is then a mixture of vacuum resid (VR) and second feedstock (F2).

From previous experience, the concentration of sediment which can be tolerated in the product (P) is known. This value of allowable sediment concentration (V−Lim) is registered in comparing means (C).

With the hydrocracking of an incremental amount of second feedstock (F2), an amount of sediment is detected in product stream (P) as measured by the analyzer (A). The Analyzer (A) indicates a value (V−A) which is representative of this amount of sediment. This value is also registered in comparing means (C). Comparing means (C) calculates a setpoint (Sp−FIC 2) for second flow rate indicator and controller (FIC 2) based on the difference between allowable sediment concentration (V−Lim) and actual sediment concentration (V−A), and resets setpoint (Sp−FIC 2) of second flow indicator and controller (FIC 2) to a second flow rate (F2(2)) at which a preselected tolerable concentration of sediment (V−Lim) in product (P) is reached. Finally, the desired final flow rate of second feedstock (F2) is reached (F2(SS)) at which actual sediment value (V−A) is less than or equal to the allowable (V−Lim). Of course, should actual sediment concentration (V−A) exceed the allowable limit (V−Lim), the setpoint (Sp−FIC 2) is reset incrementally downward until the transient passes after which the second feed rate (F2) is stepped up once again.

It is characteristic of the dynamics of the ebullated bed process that the sediment value (V−A) in product (P) will drop off after a period of second feedstock (F2) steady state flow (F2(SS)). When this drop off is noticed, the flow rate of first feedstock (F1) is incrementally reduced by means of first flow indicator and controller (FIC 1), until the flow is finally shut off.

It is characteristic of the system that these transients occur when switching from a low to a high sediment yielding feedstock or from a high to a low sediment yielding feedstock. Accordingly, the method is applied whenever a switch in feedstocks is made wherein the feedstocks have a significant difference in their sediment yield.

DETAILED DESCRIPTION OF THE INVENTION

The ebullated bed process like other catalytic processes yields differing product distributions from different feedstocks. Unlike most catalytic processes the ebullated bed process can yield different amounts of sediment at constant conditions and product slate. Operation at high sediment concentrations results in heater and process vessel fouling, thereby reducing the on-stream utilization of the unit. Low sediment production is more desirable, as it is characterized by increased unit on-stream time. Changing from one sediment producing feedstock to another causes the maximum sediment formation, increasing the sediment by a factor of 5 to 8 times the steady state concentration. The same effect occurs whether switching from a fouling to nonfouling or a nonfouling to fouling feedstock. The increased sediment production is a direct result of loss of carbon from the catalyst during the time required to equilibrate the catalyst.

Feedstocks characterized as fouling; because they cause the loss of carbon from the catalyst, are actually the best feeds since they produce low sediment and keep the unit clean. We have found the introduction of a new feed in small amounts (1 to 2 vol % increments of total feed) over several weeks, releases the same amount of carbon, but over a time period sufficiently long to avoid unit plugging and shutdown.

Successful processing of Saudi Arabian crude derived vacuum resid in concentrations up to 18 vol % of the feed has been demonstrated using the technique of incremental introduction. FCCU heavy cycle gas oil has been charged in concentrations up to 25 vol %. Both feeds yield lower sediment (<0.1 wt %) when compared to conventional sour vacuum resid (0.3 wt %).

A synergistic effect is apparent when considering that both Saudi Arabian crude and heavy cycle gas oil release carbon from the catalyst which was layed down by other types of feedstocks and prevent the coke from redepositing. Charging of visbreaker bottoms residuum increases the sediment by 0.2 wt % and is considered a bad feedstock. Processing Maya crude, heavy cycle gas oil and visbreaker residuum would be expected to produce sediment contents in excess of 0.6 wt %. All three of these feed components actual produced less sediment, 0.3 wt %.

The feedstock properties which make a low and a high sediment yielding feed are summarized:

| TYPE | Low Sediment Yielding | High Sediment Yielding |
|---|---|---|
| API Gravity | −5° to 3° | 3° to 6° |
| Sulfur, wt. % | 3 to 6 | 1 to 3 |
| Aromatics wt. % | 70+ | <70 |
| Conradson Carbon Residue, wt. % (ASTM D-4530-85) | 5 to 25 | 25+ |
| Sediment, wt. % (Shell Method Series SMS 2696-83) | 0 | 0.2 |

In general, catalytically cracked or solvent extracted raffinates are low sediment yielding feeds while non-catalytically produced stocks such as visbreaker residua are high sediment producing feeds. Crude vacuum resids which produce low sediment are highly aromatic, e.g. those derived from Alaskan North Slope, Saudi Arabian Light, Medium and Heavy crudes.

To implement the inventive strategy a sample of the hydrocracked product is analyzed using the Shell Method Series SMS 2696-83 or Institute de Petrole, IP 375/86 test. If the value is below 0.5 wt % the fouling feed is increased by opening the control valve. Residence times of 8 to 12 hours in the vacuum pipe still and associated piping require a delay between changes in fouling feed rate and analysis. The fouling feed rate is increased to the maximum allowable sediment concentration is reached.

While particular embodiments of the invention have been described, it will be understood, of course, that the invention is not limited thereto since many modifications may be made, and it is, therefore, contemplated to cover by the appended claims any such modifications as fall within the true spirit and scope of the invention. For example, both feedstocks may be routed through the vacuum pipe still, or one or both may come from a different source. In any case, the inventive method and system is applicable to any two feedstocks which demonstrate different sediment yielding characteristics.

What is claimed is:

1. In a continuous process for treating a fluid hydrocarbon feedstock with a hydrogen-containing gas at elevated catalytic reaction temperatures and pressures in the presence of a bed of particulate solid catalyst, said process comprising introducing the hydrogen-containing gas and feedstock into the lower end of a generally vertical catalyst containing reaction vessel wherein the catalyst is placed in random motion within the fluid hydrocarbon whereby the catalyst bed is expanded to a volume greater than its static volume, wherein the mixture of feedstock, gas and catalyst constitutes a turbulent zone from which zone aged catalyst is removed and fresh catalyst is added, the upper portion of which turbulent zone is defined by an interface with a substantially catalyst depleted zone from which zone hydrocracked product is removed, and wherein said fluid hydrocarbon feedstock is changed from a first, sediment yielding feedstock $F_1$ to a second feedstock of different sediment yield wherein the improvement comprises:

a. setting the flow rate of the first feedstock F1 at a first flow rate F1(1), b. initiating flow of said second feedstock F2 at a first flow rate F2(1), c. increasing the flow rate of the second feedstock to a second flow rate F2(2) at which a selected concentration of sediment in the hydrocracked product is reached, and then increasing the flow rate of the second feedstock until a selected steady state flow rate F2(SS) is reached, d. maintaining said steady state flow rate F2(SS) until the concentration of sediment drops below the selected concentration, e. reducing the flow rate of the first feedstock F1 at a rate such that the selected concentration of sediment is not exceeded.

2. The process of claim 1 wherein flow rate of the second feedstock F2 is increased incrementally.

3. The process of claim 1 wherein flow rate of the first feedstock F1 is reduced incrementally.

* * * * *